United States Patent [19]

Ito

[11] Patent Number: 4,930,975

[45] Date of Patent: Jun. 5, 1990

[54] CONTROL FOR LOAD CARRIER FOR INDUSTRIAL VEHICLE

[75] Inventor: Hideki Ito, Tokyo, Japan

[73] Assignee: Nissan Motor Company, Limited, Yokohama, Japan

[21] Appl. No.: 167,270

[22] Filed: Mar. 11, 1988

[30] Foreign Application Priority Data

Mar. 20, 1987 [JP] Japan ..... 62-65955

[51] Int. Cl.[5] ..... B65E 47/00; F15B 15/22

[52] U.S. Cl. ..... 414/635; 91/443

[58] Field of Search ..... 414/628, 629, 630, 631, 414/632, 633, 634, 635, 636, 637; 91/443

[56] References Cited

U.S. PATENT DOCUMENTS

| | | | |
|---|---|---|---|
| 3,376,792 | 4/1968 | Clarke et al. | 91/443 |
| 3,734,326 | 5/1973 | Esser | 414/635 |
| 3,929,244 | 12/1975 | Ekstrom | 414/636 |
| 4,068,773 | 1/1978 | Downing et al. | 414/636 |
| 4,132,153 | 1/1979 | Grotness et al. | 91/443 X |
| 4,147,179 | 4/1979 | Mirua | 91/443 X |
| 4,253,379 | 3/1981 | Olson | 91/443 X |
| 4,318,332 | 3/1982 | Shingu et al. | 91/443 X |
| 4,459,081 | 7/1984 | Reeves | 414/636 |
| 4,520,443 | 5/1985 | Yuki et al. | 414/636 X |
| 4,694,649 | 9/1987 | Howeth | 91/433 X |
| 4,723,107 | 2/1988 | Schmid . | |

FOREIGN PATENT DOCUMENTS

| | | | |
|---|---|---|---|
| 241702 | 9/1960 | Australia | 414/635 |
| 0122807 | 10/1984 | European Pat. Off. | 414/636 |
| 158456 | 10/1985 | European Pat. Off. | 414/635 |
| 234397 | 3/1974 | Fed. Rep. of Germany | 414/635 |
| 2724383 | 11/1978 | Fed. Rep. of Germany . | |
| 3602510 | 7/1987 | Fed. Rep. of Germany . | |
| 54-55956 | 5/1979 | Japan | 414/635 |
| 1129182 | 12/1984 | U.S.S.R. | 414/636 |
| WO/8303089 | 9/1983 | World Int. Prop. O. | 414/636 |

OTHER PUBLICATIONS

"Hydraulics and Pneumatics", 1972, Chapter Four, Velocity Servos, pp. 53–56.

"Hydraulics and Pneumatics", 1969, Jun., pp. 133–136 System Concepts, Chapter 12.

*Primary Examiner*—Robert J. Spar

*Assistant Examiner*—Robert S. Katz

*Attorney, Agent, or Firm*—Foley & Lardner, Schwartz, Jeffery, Schwaab, Mack, Blumenthal & Evans

[57] ABSTRACT

In a load carrier controlling system a lift cylinder is subjected to the weight of a load carrier and is hydraulically extendable to lift the load carrier. A lift control valve is provided which is shiftable between a neutral position and a predetermined position wherein discharge of hydraulic fluid from the lift cylinder is allowed to permit a downward movement of the load carrier. A variable flow regulator is disposed between the lift cylinder and the lift control valve, the variable flow regulator having a first state which imparts a first degree of flow restriction to hydraulic fluid flow passing therethrough in one direction from the lift cylinder to the lift control valve, and a second state which imparts a second degree of flow restriction to the hydraulic fluid flow passing therethrough in the one direction. A solenoid is provided which is adapted to cause the flow regulator to shift between the first and second states, and a control circuit is provided which selectively energizes and deenergizes the solenoid in response to the downward movement of the load carrier.

16 Claims, 7 Drawing Sheets

CONTROL FOR LOAD CARRIER FOR INDUSTRIAL VEHICLE

BACKGROUND OF THE INVENTION

The present invention relates to a control for a load carrier for an industrial vehicle, and more particularly to a control for down movement of a load carrier.

Among the industrial vehicles, there is known a forklift truck which is equipped with a load carrier to which various kinds of attachments, such as a fork assembly, may be attached. The load carrier is slidably mounted to vertical guide masts of the forklift truck and liftable by extension of a lift cylinder. The lift cylinder is retracted to allow downward movement of the load carrier. A load carrier controlling system which the inventor has made an improvement on operates as follows: Manipulating a lift control lever to shift a lift control valve from a neutral position to an up position causes operating oil from an oil pump to be supplied to a lift cylinder, causing a piston to move in such a direction as to extend the length of the lift cylinder. During this movement, the piston displaces oil out of the lift cylinder. The oil displaced out of the lift cylinder returns to a reservoir tank in an unrestricted manner. Thus, the load carrier can be lifted quickly. When the load carrier has been lifted upto a desired height, what the operator has to do is to manipulate the lift control lever to shift the lift control valve back to the neutral position. Then, the supply of oil to the lift cylinder is cut off. If it is desired to lower the load carrier from the elevated position, what the operator has to do is to manipulate the lift control lever to shift the lift control valve to a down position. Then, the load carrier starts descending owing to the total weight of the load carrier itself and a load supported thereby, causing the piston to move inwardly into the lift cylinder, resulting in retraction of the lift cylinder. This movement of the piston causes a portion of oil to be displaced out of the lift cylinder. The oil displaced out of the lift cylinder passes through the lift control valve before reaching the reservoir tank. Since the discharge rate of oil from the lift cylinder determines a speed at which the load carrier is lowered, the operator has to regulate the discharge rate of oil by controlling the degree of opening defined by the lift control valve by skillfully manipulating the lift control lever so as to decelerate the load carrier sufficiently before the load carrier is lowered down to a desired height where the fork assembly is to be removed from a pallet under the load. This operation requires a skilled technique, however.

An object of the present invention is to improve a load carrier controlling system of the above type such that, without any skilled technique, a load carrier is smoothly decelerated before being lifted down to a desired height.

SUMMARY OF THE INVENTION

According to the present invention, a lift cylinder is subjected to a weight of a load carrier and is hydraulically extendable to lift the load carrier, a lift control valve is provided which is shiftable between a neutral position and a predetermined position wherein discharge of hydraulic fluid from the lift cylinder is allowed to permit a downward movement of the load carrier, a variable flow regulator is fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction, electromagnetic means is provided which is adapted to cause the flow regulator to shift between the first and second states, and a control circuit is provided which is constructed and arranged so as to urge the electromagnetic means to shift between an energized state thereof and a deenergized state thereof during the downward movement of the load carrier so that during the downward movement of the load carrier the degree of flow restriction imparted by the variable flow regulator to the hydraulic fluid flow passing through the variable flow regulator in the one direction varies.

BRIEF DESCRIPTION OF THE DRAWINGS

FIG. 3(C) is a side elevation of the forklift truck with the load carrier reaching a desired height where a load on the load carrier lands on the upper surface of another load which the load on the load carrier is to be placed on;

DETAILED DESCRIPTION OF THE INVENTION

The present invention is further described along with various embodiments illustrated in the accompanying drawings.

Referring to FIGS. 1 to 3(C), the first embodiment of a load carrier controlling system according to the present invention is described. First of all, a common structure of a load carrier of a forklift truck is explained in connection with FIGS. 3(A), 3(B) and 3(C). In FIG. 3(A), the forklift truck includes a vehicle body 1 and a pair of parallel masts 2 which are tiltable about the vehicle's front axle assembly 4 forward in response to extension of tilt cylinders 3 and rearward in response to retraction thereof. As is seen in FIG. 3(A), the tilt cylinders 3 operatively connected between the masts 2 and the forklift truck are inclined upward so that they are subjected to a portion of a weight which the masts 2 are subjected to. The operation of the tilt cylinders 3 is briefly explained hereinafter.

Figure 1:
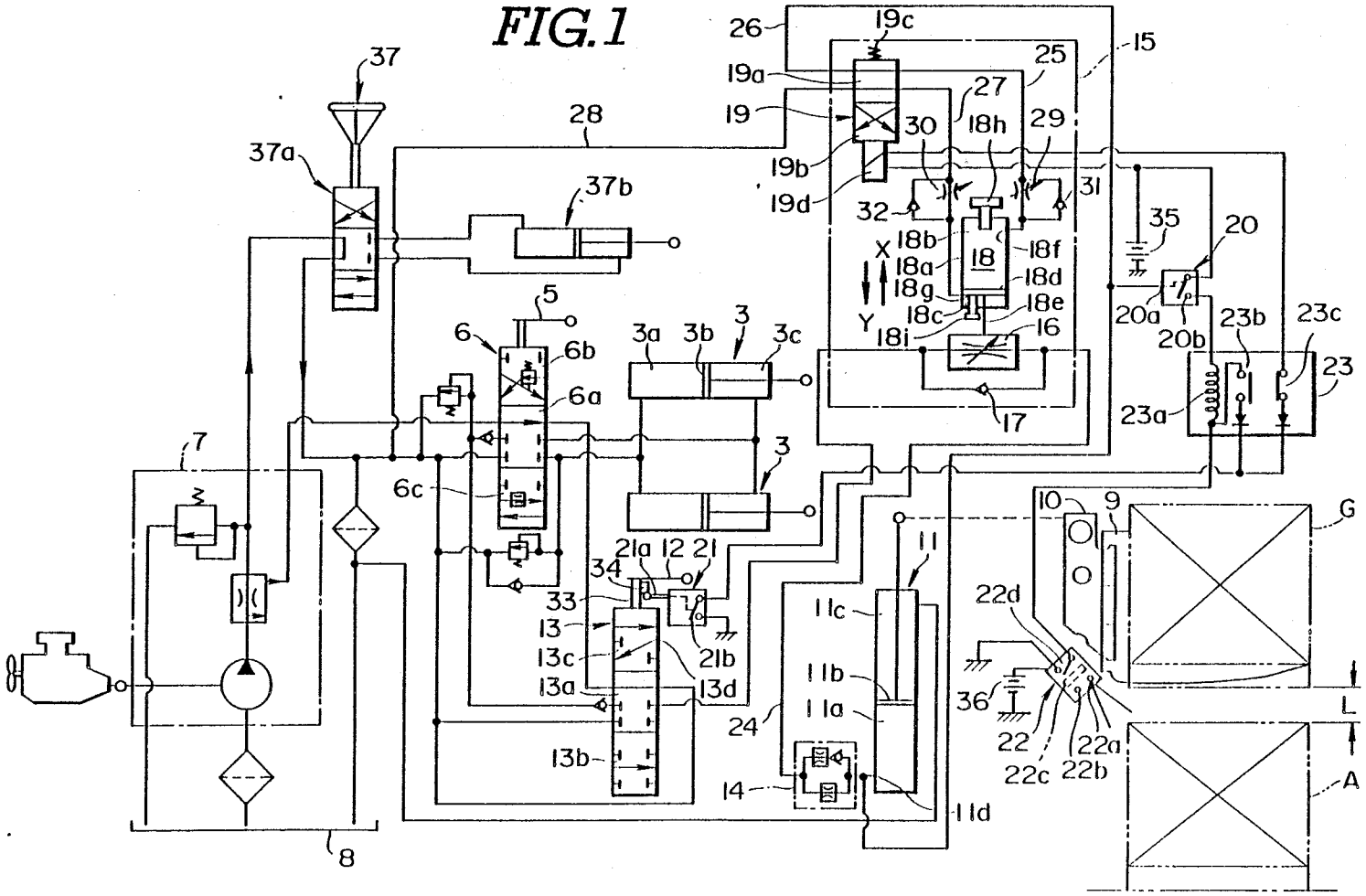
FIG. 1 is a circuit diagram of a first embodiment of a load carrying controlling system according to the present invention.

Referring to FIG. 1, the tilt cylinders 3 are hydraulically extendable or retractable under the control of a tilt control valve 6 having a tilt control lever 5. Manipulating the tilt control lever 5 to shift the tilt control valve 6 from a neutral position 6*a* to a forward tilt position 6*b* causes operating oil from an oil pump 7 to flow to servo chambers 3*a* of the tilt cylinders 3, urging pistons 3*b* within the tilt cylinders 3 to move in a direction to extend the tilt cylinders 3. Oil displaced by the pistons 3*b* out of chambers 3*c* of the tilt cylinders 3 is returned to a reservoir tank 8. If the tilt control lever 5 is manipulated to shift the tilt cylinders 3 from the neutral position 6*a* to a rearward tilt position 6*c*, oil from the oil pump 7 is supplied to the chambers 3*c* of the tilt cylinders 3, urging the pistons 3*b* to move in the opposite direction to retract the tilt cylinders 3. Oil displaced by the pistons 3*b* out of the chambers 3*a* of the tilt cylinders 3 is returned to the reservoir tank 8.

Referring back to FIGS. 3(A), 3(B) and 3(C), a load carrier 10 which is liftable along the masts 2 by a lift cylinder 11 is explained. Various kinds of attachments may be attached to the load carrier 10. Among them, a fork assembly 9 is securely attached to the load carrier 10 in this embodiment. The load carrier 10 is lifted along the masts 2 by extension of the lift cylinder 11, while it is lowered in response to the retraction of the lift cylinder 11. As will be understood as the description proceeds, the load carrier 10 starts descending immediately after the lift cylinder 11 has been conditioned to a state ready for retraction, and the load carrier 10 is lowered at a speed which is determined mainly by the total weight of the load carrier 10 including the fork assembly 9 with a load G carried thereon if the same degree of flow restriction is imparted to a flow of oil discharged out of the lift cylinder 11 toward the reservoir tank 8. The operation of the lift cylinder 11 is briefly explained hereinafter.

Referring again to FIG. 1, the lift cylinder 11 is hydraulically extendable or retractable under the control of a lift control valve 13 having a lift control lever 12. Manipulating the lift control lever 12 to shift the lift control valve 13 from a neutral position as illustrated at 13*a* to an up position as illustrated at 13*b* causes oil under constant pressure to flow therethrough to a bottom connection port 11*d* of the lift cylinder 11 via a one-way check valve 17 arranged in parallel to a variable flow orifice valve 16, causing a pressure build-up within a lower chamber 11*a* of the lift cylinder 11, urging a piston 11*b* within the lift cylinder 11 to move upward in response to extension of the lift cylinder 11. This upward movement of the piston 11*b* displaces oil out of an upper chamber 11*c* of the lift cylinder 11. The oil displaced out of the upper chamber 11*c* returns to the reservoir tank 8. The load carrier 10 is lifted in accordance with this upward movement of the piston 11*b* of the lift cylinder 11. When the load carrier 10 is lifted upto a desired height, the lift control lever 12 must be manipulated to shift the lift control valve 13 to the neutral position as illustrated at 13*a*. Subsequently, if it is desired to lower the load carrier 10, what the operator has to do is to manipulate the lift control lever 12 to shift the lift control valve 13 from the neutral positon 13*a* to a down position as illustrated at 13*c*. This cuts off the supply of oil to the lower chamber 11*a* of the lift cylinder 11 and allows discharge of oil from the bottom connection port 11*d* of the lift cylinder 11 toward the reservoir tank 8. Since it is subjected to the total weight of the load carrier 10 and of a load G thereon, the load carrier 10 starts descending urging the piston 11*b* to move into the lift cylinder 11, displacing oil out of the lower chamber 11*a* of the lift cylinder 11. The oil displaced via the bottom connection port 11*d* out of the lower chamber 11*a* of the lift cylinder 11 passes through a flow restrictor 14, a fluid line 24, a variable flow regulator generally denoted by the reference numeral 15, and lift control valve 13 to the reservoir tank 8. In order to prevent creation of negative pressure in the upper chamber 11*c* of the lift cylinder 11 during this downward movement of the piston 11*b*, an arrangement is made to allow supply of oil to the upper chamber 11*c* of the lift cylinder 11 from the reservoir tank 8.

The variable flow regulator 15 comprises a variable flow orifice valve 16 fluidly disposed between the lift cylinder 11 and the lift control valve 13. The variable flow regulator 15 has a first state wherein it imparts the maximum degree of flow restriction to the oil flow passing through the variable flow orifice valve 16 in a direction from the lift cylinder 11 toward the reservoir tank 8. It also has a second state wherein it imparts the minimum degree of flow restriction to the oil flow passing through the variable flow orifice valve 16 in the direction from the lift cylinder 11 toward the reservoir tank 8. The variable flow regulator 15 used in this embodiment is of the continuously variable type so that the degree of flow restriction is continuously variable between maximum and minimum degrees. The variable flow regulator 15 includes a hydraulic actuator 18 for varying an opening area of the variable flow orifice 16. The hydraulic actuator 18 includes a cylinder 18*a* and a piston 18*d* slidable therein.

The opening area of the variable flow orifice valve 16 is controlled by the piston 18*d*. The piston 18*d* is connected via a rod 18*e* to a valve element, not shown, of the variable flow orifice valve 16 such that the opening area of the variable flow orifice valve 16 is the minimum when the piston 18*d* abuts on an adjuster 18*i* to assume the illustrated position. The piston 18*d* is slidable from the illustrated position toward another adjuster 18*h* in a direction as indicated by an arrow X. The opening area of the variable flow orifice valve 16 increases progressively as the piston 18*d* moves in this direction as indicated by the arrow X until it becomes the maximum when the piston 18*d* comes into abutting engagement with the adjuster 18*h*. If, subsequently, the piston 18*d* moves in a direction as indicated by an arrow Y toward the position where it abuts on the adjuster 18*i*, the opening area of the variable flow orifice valve 16 decreases. As will be readily understood from the above description, the stroke of the piston 18*d* is limited by the adjusters 18*i* and 18*h*. The minimum opening area of the variable flow orifice valve 16 can be adjusted by turning the adjuster 18*i* to increase or decrease its protrusion into the cylinder 18*a*, while the maximum opening area thereof can be adjusted by turning the adjuster 18*h* to increase or decrease its protrusion into the cylinder 18*a*.

The piston 18*d* is slidably disposed in the cylinder 18*a* and divides the inside thereof into a first chamber 18*b* and a second chamber 18*c*. Supply of oil to and discharge thereof from the first chamber 18*b* is effected via a connection port 18*f*, while supply of oil to and discharge thereof from the second chamber 18*c* is effected via another connection port 18*g*. In order for the piston 18*d* of the actuator 18 to move at a speed variable with the weight of a load carried by the load carrier 10, a pressurized oil that is variable with the weight of the load during the downward movement of the load carrier 10 is supplied to the first chamber 18*b* or the second chamber 18*c*, selectively, under the control of a normally open selector valve 19. In this embodiment, a pressurized oil developed in the lower chamber 11*a* of the lift cylinder 11 is used as the above-mentioned pressurized oil. The selector valve 19 is of the electromagnetic operated type and includes a solenoid 19*d* and a return spring 19*c*. Upon deenergization of the solenoid 19*d*, the selector valve 19 assumes a spring set position as illustrated at 19*a* under the bias of the return spring 19*c*. In this position, oil under pressure in the lower chamber 11*a* of the lift cylinder 11 is supplied to the first chamber 18*b* of the actuator 18 via a fluid line 26, a fluid line 25, opening a one-way check valve 31 that bypasses an adjustable orifice 29 provided in the line 25, and the port 18*f*, while oil discharged out of the second chamber 18*c* of the actuator 18 flows via a line 27 provided with an adjustable orifice 30, and a fluid return line 28 toward the reservoir tank 8. Supplying electric current to energize the solenoid 19*d* causes the selector valve 19 to be shifted from the spring set position 19*a* to a second operative position as illustrated at 19*b*. In this position, oil under pressure developed in the lower chamber 11*a* of the lift cylinder 11 is supplied to the second chamber 18*c* of the actuator 18 via the fluid line 26, line 27, opening one-way check valve 32 that is arranged to bypass the adjustable orifice 30 provided in the line 27, and the connection port 18*g*, while oil discharged out of the first chamber 18*b* of the actuator 18 flows via the fluid line 25 provided with the adjustable orifice 29 and return line 28 toward the reservoir tank 8.

The variable flow regulator 15 also includes a one-way check valve 17 arranged to bypass the variable flow orifice valve 16 to allow unrestricted flow of oil from the lift control valve 13 to the lower chamber 11*a* of the lift cylinder 11 via the fluid line 24 and the connection port 11*d*. Thus, the variable flow regulator 15 has a third state wherein substantially no restriction is imparted to an oil flow passing therethrough in the opposite direction from the lift control valve 13 toward the lift cylinder 11.

In order to selectively energize and deenergize the solenoid 19*d* in response to a downward movement of the load carrier 10, a control circuit is provided. The control circuit includes a battery 35, a pressure sensor 20, a relay 23 having a normally closed relay switch 23*c*, a normally open relay switch 23*b* and a relay coil 23*a*, a lift control lever position sensor 21, and a load carrier height sensor 22.

The solenoid 19*d* has one terminal connected to the battery 35 and the other terminal connected to the normally closed relay switch 23*c* which in turn is connected to the lift control lever position sensor 21. The relay coil 23*a* has one terminal connected to the pressure sensor 20 which is in turn connected to the battery 35 and the other terminal connected to the load carrier height sensor 22. The pressure sensor 20 is operable in response to an oil pressure at a port 20*a* opening at the line 26 having one end communicating with the lower chamber 11*a* of the lift cylinder 11 via the bottom connection port 11*d*. This pressure sensor 20 includes a normally open ON/OFF type switch 20*b* designed to be closed when the oil pressure exceeds a predetermined value. This predetermined value is so selected that the switch 20*b* of the sensor 20 is open when no load is carried by the fork assembly 9 of the load carrier 10, but it is closed when a load is carried by the fork assembly 9 of the load carrier 10. The lift control lever position sensor 21 includes a normally open switch 21*b* and an actuator rod 21*a* which abuts operatively on a cam 34 formed on a control rod 33 operatively connecting the lift control lever 12 to the lift control valve 13. The construction and arrangement are such that shifting the lift control valve 13 from its neutral position 13*a* to the down position 13*c* by manipulating the lift control lever 12 causes the cam 34 to push the actuator rod 21*a* in such a direction as to close the switch 21*b* and thus the switch 21*b* is closed only when the lift control valve 13 assumes the down position 13*c*. The load carrier height position sensor 22 includes a battery 36, a sonic wave transmitter 22*a*, a reflected wave receiver 22*b*, a central processing unit (CPU) 22*c* and a switch 22*d*. Based on the phase difference between the transmitted wave and the reflected wave, the CPU 22*c* calculates a distance L between the bottom of the load carrier 10 and the upper surface of a load A which the load G on the load carrier 10 is to be placed on. An output signal is generated by the CPU 22*c* when the distance L calculated becomes shorter than a predetermined value and the switch 22*d* is closed in response to this output signal.

Figure 2:
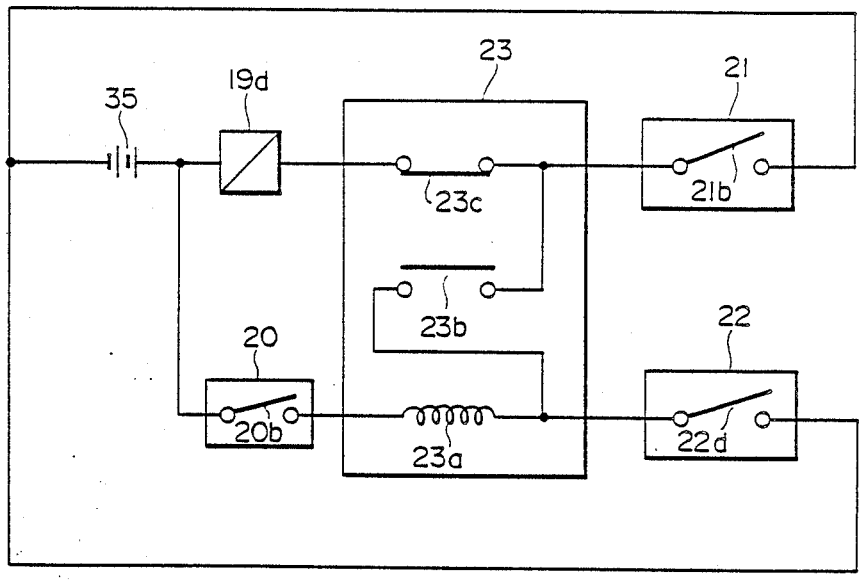
FIG. 2 is a diagram of a control circuit.

As best seen in FIG. 2, since the relay coil 23*a* is arranged in series with the pressure sensor 20, the normally open relay switch 23*b* and the lift control lever position sensor 21, the relay coil 23*a* is kept energized until either the pressure sensor 20 or the load carrier height sensor 22 is closed once the relay switch 23*b* has been closed in response to energization of the relay coil 23*a*.

Referring back to FIG. 1, there are also illustrated a power steering system 37 including a power steering control valve 37*a* and a power cylinder 37*b*. Since the power steering system 37 is nothing to do with the subject matter, further description thereof is omitted.

The first embodiment of the load carrier controlling system operates as follows:

First, an operation to lower the load carrier 10 with a load thereon is explained.

Figure 3A:
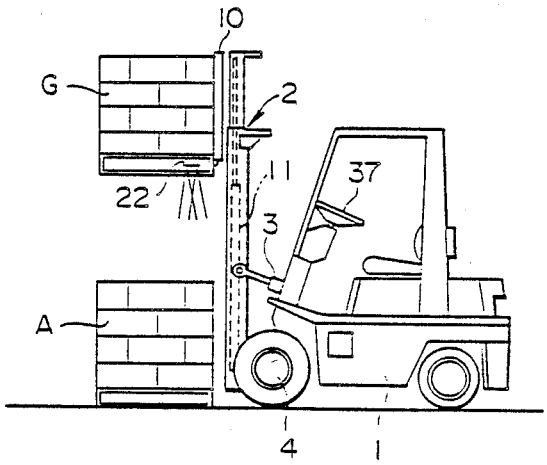
FIG. 3(A) is a side elevation of a forklift truck equipped with the load carrier lifted to the highest position.
Figure 3B:
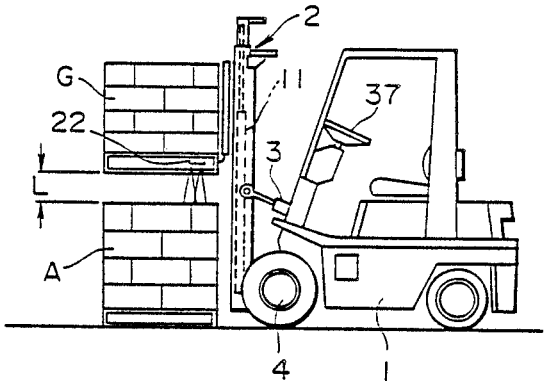
FIG. 3(B) is a side elevation of the forklift truck with the load carrier which starts decelerating during its downward movement from the highest position.
Figure 3C:
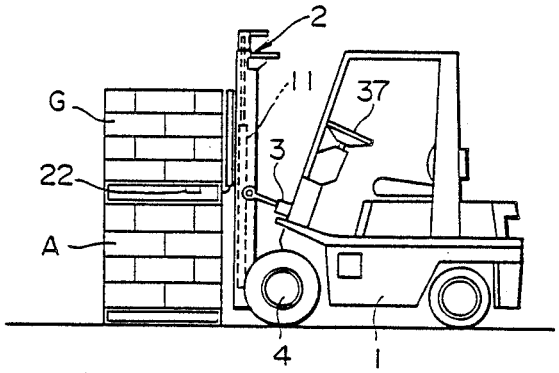

In the case where the distance L is longer than the predetermined value, the switch 20*b* of the pressure sensor 20 is closed due to pressure rise caused by the load on the load carrier 10, the switch 22*d* of the load carrier height sensor 22 is open so that the relay coil 23*a* of the relay 23 is left deenergized and thus the normally closed switch 23*c* and the normally open switch 23*b* stay in the positions as illustrated in FIG. 1. Assuming now that the lift control valve 13 is in the neutral position 13*a* and thus the switch 21*b* of the lift control lever position sensor 21 is open, no current will flow through the solenoid 19*d* so that the selector valve 19 assumes the illustrated position. Thus, the oil pressure at the bottom connection port 11*d* opening to the lower chamber 11*a* of the lift cylinder 11 acts on the piston 18*d* of the actuator 18 in the direction indicated by the arrow Y, holding the piston 18*d* to the illustrated position. As a result, the opening area of the variable flow orifice 16 is kept to the minimum degree. Under these conditions, manipulating the lift control lever 12 to shift the lift control valve 13 from the neutral position 13*a* to the down position 13*c* will cause the switch 21*b* of the lift control lever position sensor 21 to be closed, allowing electric current to be supplied via the normally closed relay switch 23*c* to pass through the solenoid 19*d*. As a result, the solenoid 19*d* is energized to shift the selector valve 19 from the spring set position 19*a* to the second position 19*b*, allowing the pressurized oil at the bottom connection port 11*d* to be supplied to the second chamber 18c of the actuator 18, urging the piston 18d to move in the direction as indicated by the arrow X. This movement of the piston 18d of the actuator 18 is gradual enough to cause a gradual increase in the opening area of the variable flow orifice valve 16. Oil displaced by the piston 18d out of the first chamber 18b of the actuator 18 flows toward the reservoir tank 8 at a rate determined by the adjustable orifice 29. The speed at which the piston 18d is lowered is variable in response to the oil pressure that is variable with the weight of the load G on the load carrier 10. The oil displaced by the piston 11b of the lift cylinder 11 out of the lower chamber 11a passes through the opening area of the variable flow orifice valve 16. Thus, a flow restriction is imparted to the flow of oil discharged from the lift cylinder 11 and this flow restriction is smoothly and gradually decreased from the maximum degree toward the minimum degree. This results in a smooth and gradual acceleration of the load carrier 10 after it starts descending, providing a so-called "soft start". Reference is hereby made to FIG. 3(A). When, upon expiration of time, the piston 18 of the actuator 18 comes into abutting engagement with the adjuster 18h, the opening area of the variable flow orifice valve 16 increases to the maximum degree and thus the minmum degree of flow restriction is imparted to the flow of oil passing through the variable flow orifice valve 16. Subsequently after the flow restriction imparted to the flow of oil passing through the variable flow orifice valve 16 has decreased to the minimum degree, the load carrier 10 is lowered at a relatively high normal speed. The length of the above-mentioned time can be varied by adjusting the adjustable orifice 29.

When the load carrier 10 has lowered to a height where the distance L becomes shorter than the predetermined value, the switch 22d of the load carrier height sensor 22 is closed with the switch 20b of the pressure switch 20 is left closed, cutting off supply of electric current passing through the solenoid 19d, causing the selector valve 19 to shift back to the spring set position 19a due to the return spring 19c. This causes the oil displaced out of the lower chamber 11a of the lift cylinder 11 to be supplied to the first chamber 18b of the actuator 18, urging the piston 18d to move in the direction as indicated by the arrow Y, decreasing the opening area of the variable flow orifice valve 16, thus increasing the degree of flow restriction imparted to the oil flow passing through the variable flow orifice valve 16. Since the flow of oil discharged from the lift cylinder 11 toward the reservoir tank 8 passing through the variable flow orifice valve 16 is gradually restricted, the load carrier 10 is gradually decelerated. Upon expiration of a time when the piston 18d comes into abutting engagement with the adjuster 18i, the opening degree of the variable flow orifice valve 16 decreases to the minimum degree and thus the maximum degree of flow restriction is imparted to the flow of oil passing through the variable flow orifice valve 16. After the expiration of this time, the load carrier 10 is lowered at a very slow speed. This very slow speed state is maintained because the normally open relay switch 23b is kept closed in response to energization of the relay coil 23a to keep the normally closed relay switch 23c open. The length of this time can be varied by adjusting the adjustable orifice 30. When the load carrier 10 has landed on the upper surface of the load A, the lift control lever 12 is manipulated to shift the lift control valve 13 from the down position 13c to the neutral position 13a. As a result, the switch 21b of the manual lever position sensor 21 is opened. Then, the forklift truck is driven back away from the load G to remove the fork assembly 9 from the pallet under the load G. Since the load carrier 10 has been unloaded, the switch 20b of the pressure sensor 20 is opened. The supply of electric current passing through the solenoid 23a is cut off, allowing the normally open relay switch 23b to be opened and the normally closed relay switch 23c to be closed.

How the load carrier 10 is lifted from this position will now be explained.

In order to lift the load carrier 10, the lift control lever 12 is manipulated to shift the lift control valve 13 from the neutral position 13a to the up position 13b. This allows pressurized oil discharged from the oil pump 7 to be supplied to the lower chamber 11a of the lift cylinder 11 via the fluid line 24, opening the check valve 17 arranged to bypass the variable flow orifice valve 16. Thus, substantially no flow restriction is imparted to this flow of oil from the oil pump 7 toward the lift cylinder 11. Thus, the load carrier 10 is lifted at a relatively high normal speed in response to the flow rate of oil supplied to the lower chamber 11a of the lift cylinder 11.

The case where the load carrier 10 is lowered without any load thereon will now be explained.

In this case, the switch 20b of the pressure sensor 20 will not be closed so that no electric current will pass through the relay coil 23a. In order to lower the load carrier 10, the lift control lever 12 is manipulated to shift the lift control valve 13 from the neutral position 13a to the down position 13c, causing the switch 21b of the control lever position sensor 21 to be closed to allow electric current to pass through the solenoid 19d, shifting the selector valve 19 from the spring set porition 19a to the second position 19b. This causes oil to be supplied from the lower chamber 11a of the lift cylinder 11 to the second chamber 18c of the actuator 18, urging the piston 18d to move in the direction of the arrow X. As the piston 11b of the lift cylinder 11 compresses the oil within the lower chamber 11a in response to downward movement of the load carrier 10, the piston 18d of the actuator 18 moves in the direction as indicated by the arrow X, resulting in a gradual increase in the opening degree of the variable flow orifice valve 16. Thus, the load carrier 10 is accelerated until it descends at the beforementioned relatively high normal speed.

Figure 4:
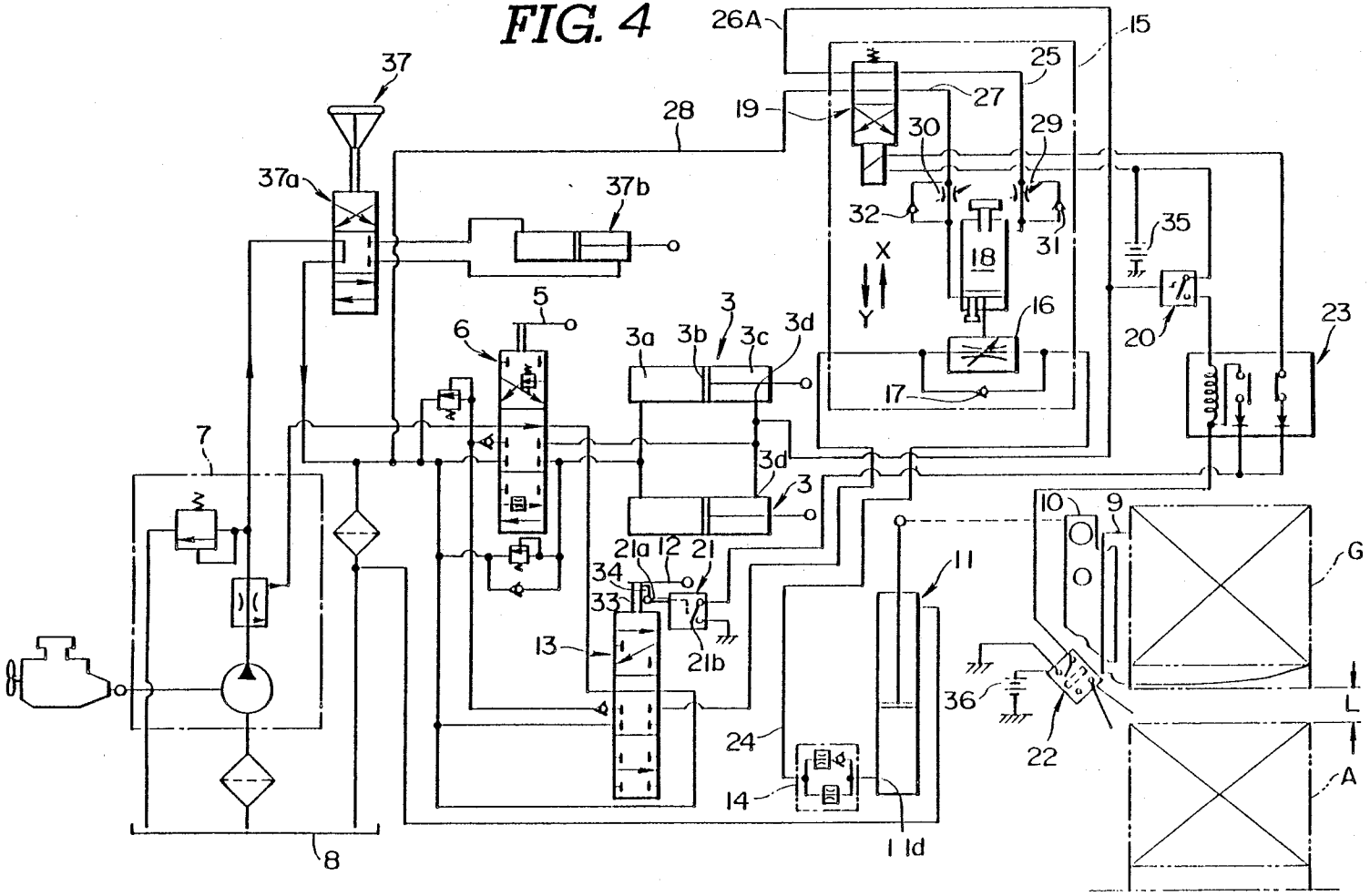
FIG. 4 is a circuit diagram of a second embodiment of a load carrier controlling system according to the present invention.

The second embodiment of the load carrier controlling system according to the present invention is explained in connection with FIG. 4.

This second embodiment is substantially the same as the first embodiment except that in the second embodiment, pressurized oil building up in chambers 3c of tilt cylinders 3 is supplied to a selector valve 19 via a line 26A and operates a pressure sensor 20, whereas in the first embodiment, the pressurized oil within the lower chamber 11a of the lift cylinder 11 is supplied to the selector valve 19 via the line 26 and operates the pressure sensor 20. This second embodiment provides substantially the same effect as that provided by the first embodiment because pressure of oil building up in the chambers 3c in the tilt cylinders 3 increases in response to the weight of a load G carried by a load carrier 10.

Figure 5:
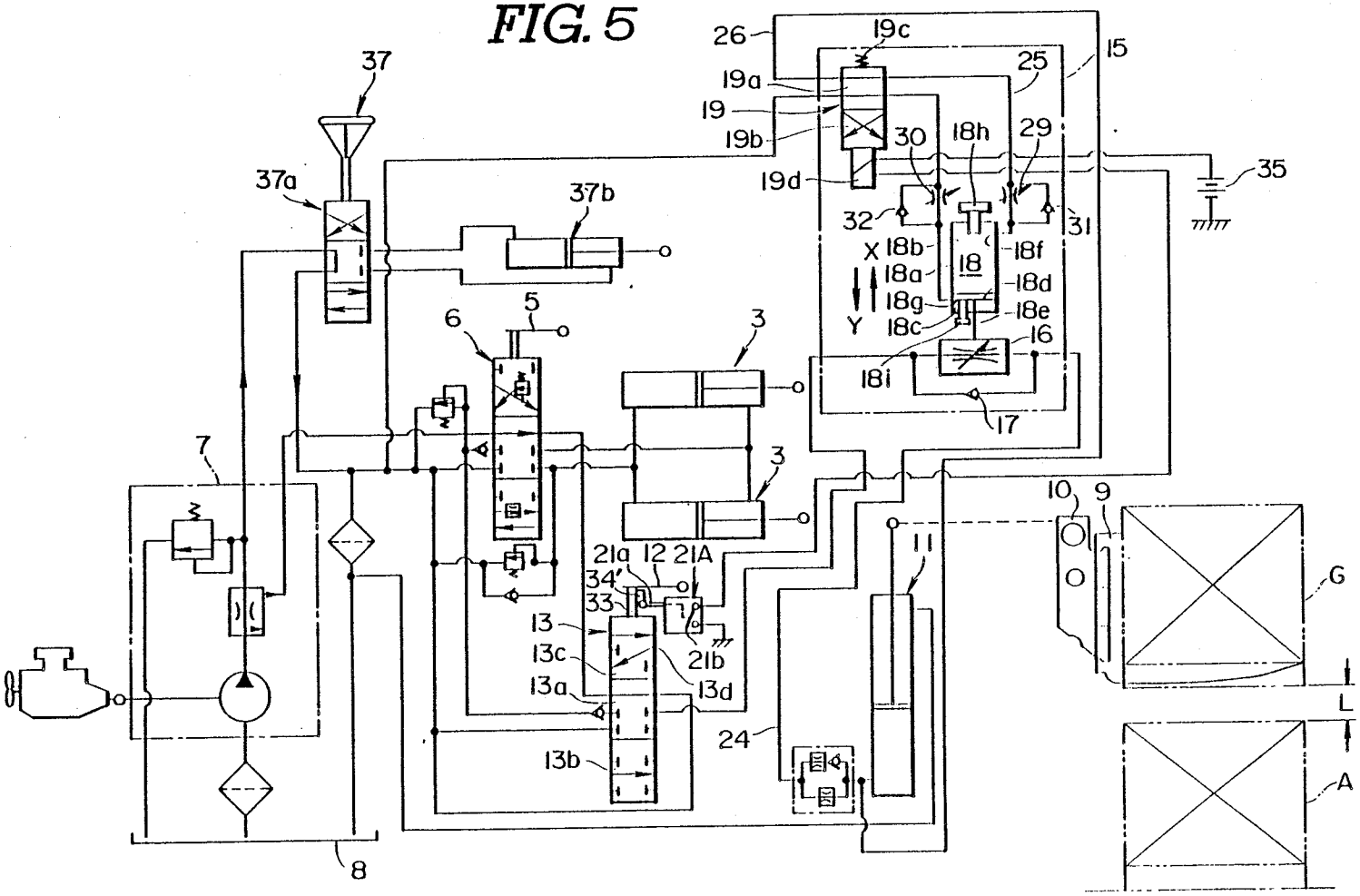
FIG. 5 is a circuit diagram of a third embodiment of a load carrier controlling system according to the present invention.

The third embodiment of the load carrier controlling system according to the present invention is explained in connection with FIG. 5. This third embodiment is substantially the same as the first embodiment except for the control circuit for solenoid 19d. According to this embodiment, the pressure sensor 20, load carrier height sensor 22, and relay 23 used in the first and second embodiments have been eliminated. Instead, the control circuit used in this embodiment includes a modified lift control lever position sensor 21A. This sensor 21A is substantially the same as the sensor 21 of the first embodiment except for the configuration and arrangement of a cam 34'. The configuration and arrangement of the cam 34' are chosen such that, upon manipulating a lift control lever 12 to move a rod 33 in a downward direction as viewed in FIG. 5 so as to shift a lift control valve 13 from a neutral position 13*a* to a down position 13*c*, this downward movement of the rod 33 will leave a switch 21*b* open until the rod 33 reaches a predetermined position even after the lift control valve 13 has shifted to the down position 13*c*, but further movement of the rod 33 beyond this predetermined position will close the switch 21*b*, whereas, upon manipulating the lift control lever 12 to be moved back in an upward direction as viewed in FIG. 5 so as to shift the lift control valve 13 from the down position 13*c* back to the neutral position 13*a*, this upward movement of the rod 33 will keep the switch 21*b* closed until the rod 33 moves back to the above-mentioned predetermined position, but further upward movement of the rod 33 beyond the predetermined position will open the switch 21*b* even though the down position 13*c* of the lift control valve 13 is maintained.

According to this third embodiment, an acceleration of a load carrier 10 at the beginning of its downward movement and a deceleration thereof at the end of the downward movement are initiated by manipulating the lift control lever 12 to move the rod 33 beyond the predetermined position and subsequently back to the predetermined position, respectively. In order to lower the load carrier 10, the operator must manipulate the lift control lever 12 to cause the rod 33 to move in the downward direction beyond the predetermined position to shift the lift control valve 13 from the neutral position 13*a* to the down position 13*c*. This closes the switch 21*b* of the lift control lever position sensor 21A, allowing electric current to pass through a solenoid 19*d*, shifting a selector valve 19 from a spring set position 19*a* to a second operative position 19*b*, causing a piston 18*d* of an actuator 18 to move upwardly as viewed in FIG. 5 in a direction as indicated by an arrow X. As a result, the load carrier 10 gradually accelerates at the beginning of the downward movement. When a distance L between the lower surface of the load carrier 10 and the upper surface of a load A on which a load G on the load carrier 10 is to be placed becomes shorter than a predetermined value, the operator must manipulate the lift control lever 12 to move the rod 33 back to the predetermined position. At this predetermined position, the switch 21*b* of the sensor 21A is opened to cut off the supply of electric current passing through the solenoid 19*d* to deenergize the solenoid even though the lift control valve 13 stays in the down position 13*c*. This deenergization of the solenoid 19*d* causes the selector valve 19 to shift back to the spring set position 19*a*, causing the piston 18*d* of the actuator 18 to move back to the illustrated position in a direction as indicated by an arrow Y. As a result, the load carrier 10 gradually decelerates at the end of the downward movement.

The fourth embodiment of the load carrier controlling system according to the present invention is explained in connection with FIG. 6.

This fourth embodiment is similar to the first embodiment shown in FIG. 1. However, the former is different from the latter in that instead of the variable flow orifice valve 16 with the actuator 18 and the solenoid operated selector valve 19 (see FIG. 1), a flow regulator 15A used in this embodiment includes a manually adjustable orifice 16A, a bypass fluid line 38 arranged in parallel to the adjustable orifice 16A, and a selector valve 39 fluidly disposed in the bypass line to close the bypass line in response to energization of a solenoid 39*d*. The selector valve 39 includes a return spring 39*c* and has a spring set position 39*a* wherein fluid flow through the bypass fluid line 38 is allowed, and a second operative position 39*b* wherein the bypass fluid line 38 is closed and thus no fluid flow therethrough is allowed. The selector valve 39 is shiftable to the second operative position 39*b* in response to energization of the solenoid 39*d*. Another difference resides in a control circuit. The control circuit for selectively energizing the solenoid 39*d* includes a solenoid 40 with a relay coil 40*a* connected in series with a pressure sensor 20A and a load carrier height sensor 22 similar to the counterparts 23*a*, 20 and 22 of the control circuit shown in FIG. 1. However, different from the counterpart, the pressure sensor 20A has a pressure receiving port 20*a* opening to a line 24 having one end connected to a flow restrictor 14. This sensor 20A includes a switch 20*b* which is designed to be closed by fluid pressure when a load G is carried by a load carrier 10. The relay 40 has a normally open relay switch 40*b* connected in series with the solenoid 39*b*. When no electric current passes through the solenoid 39*d*, the flow regulator 15A assumes a second state wherein the minimum degree of flow restriction is imparted to oil flow passing therethrough in a direction from a lift cylinder 11 to a lift control valve 13, whereas, in the case of the first embodiment shown in FIG. 1, the second state is established by the flow regulator 15 when the solenoid 19*d* is energized. Upon energization of the solenoid 39, since the selector valve 39 is shifted from the position 39*a* to the position 39*b*, the flow regulator 15A assumes a first state wherein the maximum degree of flow restriction is imparted to oil flow passing therethrough in the direction from the lift cylinder 11 to the lift control valve 13.

Figure 6:
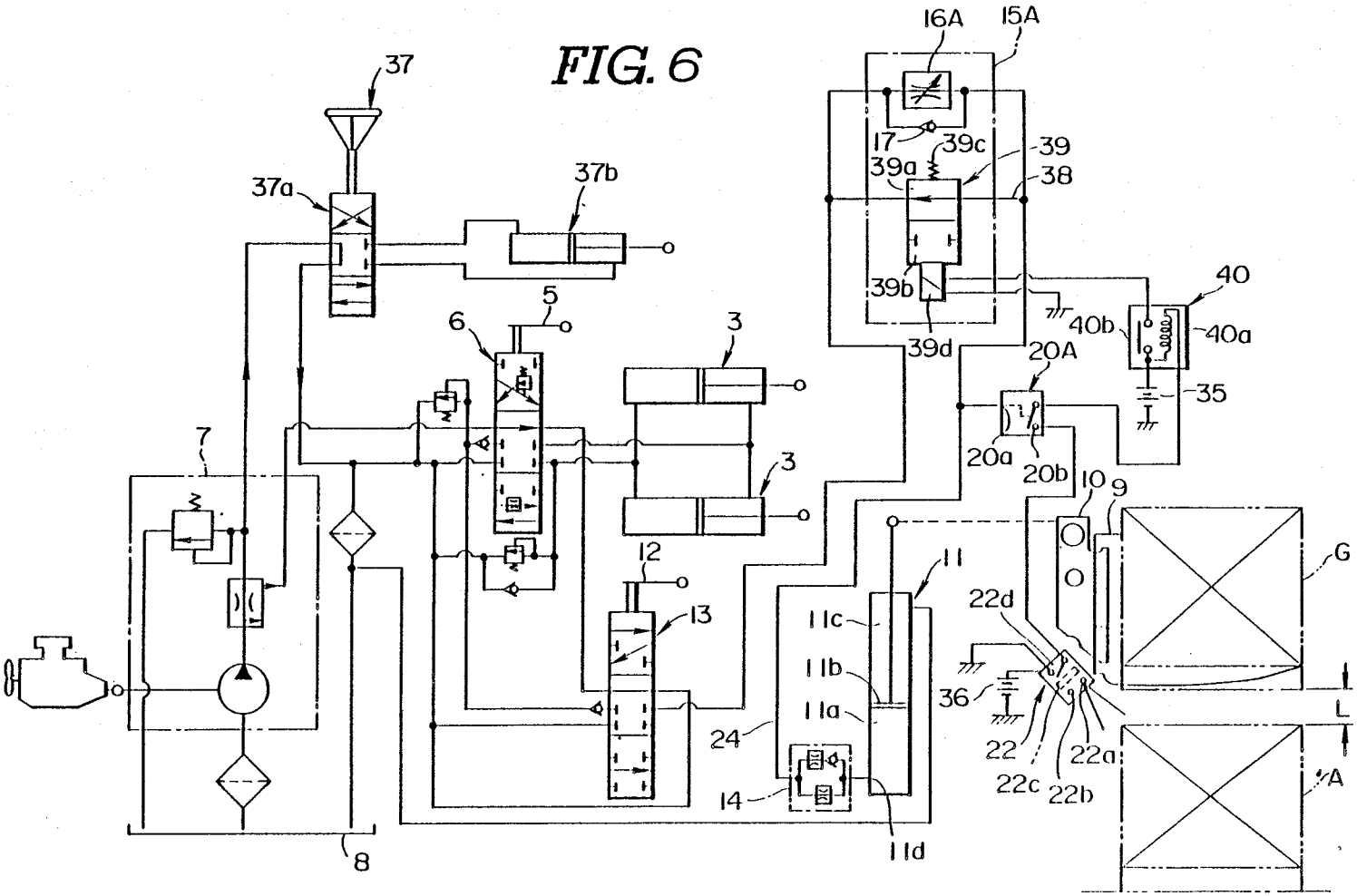
FIG. 6 is a circuit diagram of a fourth embodiment of a load carrier controlling system according to the present invention.

As will be readily understood from FIG. 6, the solenoid 39*d* is energized when a distance L between the lower surface of the load carrier 10 and the upper surface of a load A on which a load G on the load carrier 10 is to be placed is shorter than a predetermined length as long as the pressure sensor 20A detects the presence of the load G on the load carrier 10.

In the case of the load carrier controlling system shown in FIG. 6, since the selector valve 39 is electromagnetically controlled by the solenoid 39*d*, a change between the first and second states established by the flow regulator 15A is not gradual.

Figure 7:
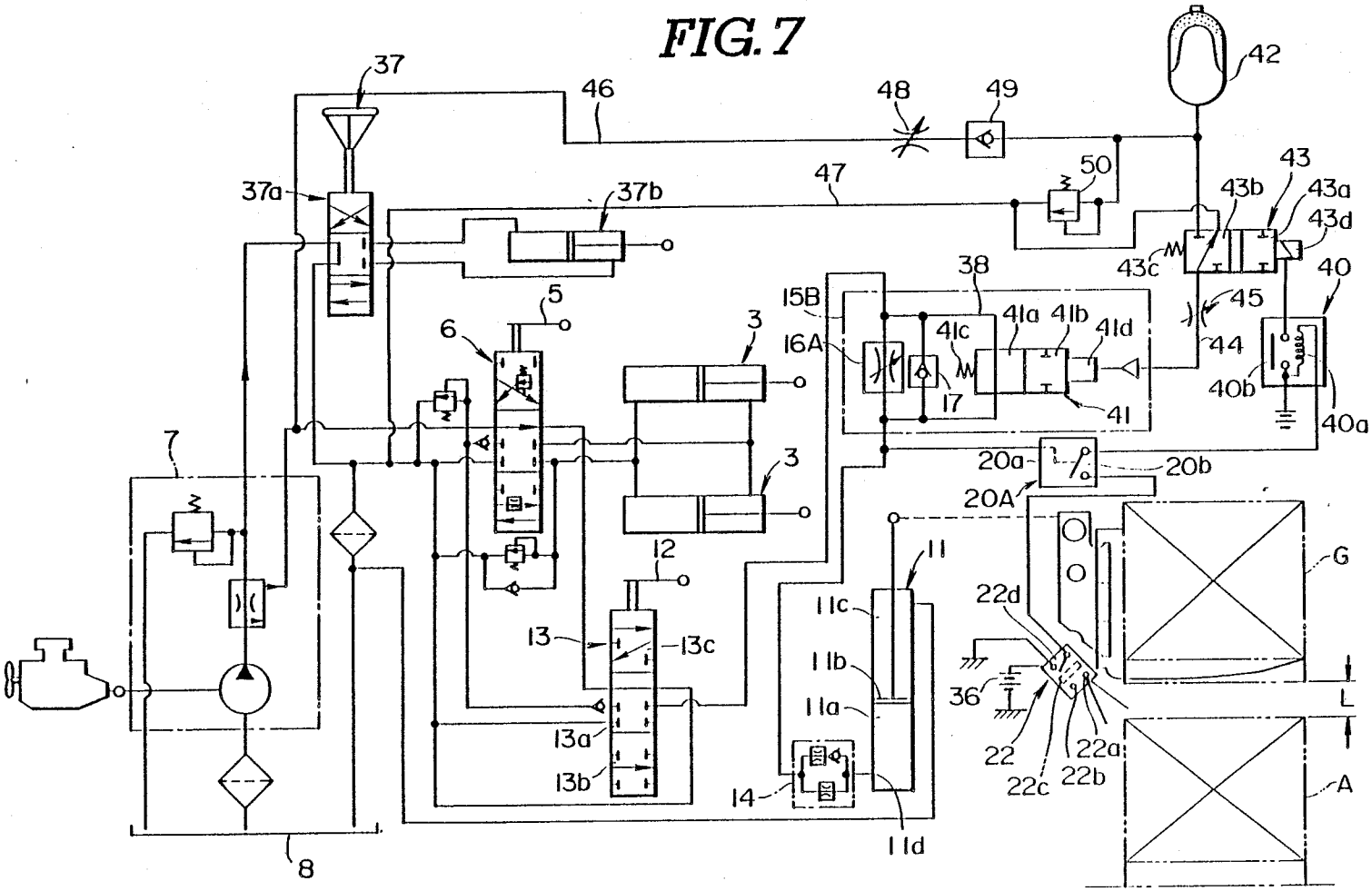
FIG. 7 is a circuit diagram of a fifth embodiment of a load carrier controlling system according to the present invention.

The last and fifth embodiment illustrated in FIG. 7 has eliminated this drawback experienced in the system shown in FIG. 6.

Although this fifth embodiment of the load carrier controlling system according to the present invention is substantially the same as the fourth embodiment shown in FIG. 6, it is different from the latter in that a selector valve 41 fluidly disposed in a bypass line 38 is hydraulically controlled by a pilot circuit which comprises a source of constant pressure that includes a fluid supply line 46 with an adjustable orifice 48 and a one-way check valve 49, an accumulator 42, an oil discharge line 47, and a pressure regulator 50. Also included is a solenoid operated selector valve 43, and a manually adjustable orifice 45. It includes a return spring 41*c* and a hydraulically operated servo motor 41*d*. The selector valve 41 has a spring set position as illustrated at 41*a* wherein the bypass line 38 is opened and a second operative position as illustrated at 41*b* wherein the bypass line 38 is closed and thus there is no fluid flow passing therethrough. The selector valve 41 shifts from the spring set position 41*a* to the second position 41*b* at a rate proportional to the magnitude of a pressure build-up within the servo motor 41*d*. Thus, during shifting, the bypass line 38 is gradually closed in response to the pressure build-up at the servo motor 41*d*. The solenoid operated selector valve 43 fluidly disposed between the servo motor 41*d* and the accumulator 42 includes a return spring 43*c* and a solenoid 43*d*. It includes a spring set position as illustrated at 43*b* wherein oil is discharged from the servo motor 41*d* toward a reservoir tank 8 via the discharge or return line 47 and a second operative position as illustrated at 43*a* wherein oil under constant fluid pressure is supplied from the pressure regulator 42 toward the servo motor via a fluid line 44 provided with the adjustable orifice 45. The solenoid operated selector valve 43 shifts quickly from the spring set position 43*b* to the second position 43*a* upon energization of the solenoid 43*d* caused by electric current passing therethrough. The solenoid 43*d* is connected in series with normally open relay switch 40*b* of a relay 40 in the same manner as the fourth embodiment shown in FIG. 6.

Assuming now that a switch 20*b* of a pressure sensor 20A is closed, closing a switch 22*d* of a load carrier height sensor 22 causes energization of a relay coil 40*a* of the relay 40. The energization of the relay coil 40*a* causes the normally open relay switch 40*b* to be closed, allowing electric current to pass through the solenoid 43*d*, causing the selector valve 43 to shift from the spring set position 43*b* to the second position 43*a*, allowing oil under constant pressure to pass therethrough. As a result, there occurs a rapid pressure increase in the line 44 upstream of the adjustable orifice 45. The transmission of this pressure increase to the servo motor 41*d*, however, is delayed due to the provision of the adjustable orifice 45, causing a gradual pressure build-up at the servo motor 41*d*. The rate at which the pressure builds up at the servo motor 41*d* is adjustable by adjustably varying the opening area of the orifice 45. As a result, the bypass line 38 is gradually closed, causing a flow regulator 15B to change from one state to the other at a gradual rate that is adjustable by the adjustable orifice 45.

What is claimed is:

1. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which is constructed and arranged to cause the electromagnetic means to shift between an energized state thereof and a deenergized state thereof during the downward movement of the load carrier so that during downward movement of the load carrier the degree of flow restriction imparted by the variable flow regulator to hydraulic fluid flow passing through the variable flow regulator in the one direction varies;

wherein the first degree of flow restriction is a maximum degree thereof, and the second degree of flow restriction is a minimum degree thereof;

wherein the variable flow regulator comprises a variable flow orifice valve fluidly disposed between the lift cylinder and the lift control valve, a hydraulic actuator including a second cylinder and a piston slidable therein and operatively connected to the variable flow orifice valve to vary an opening area of the variable flow orifice valve in response to slidable movement of the piston in the second cylinder, and a selector valve means operable by the electromagnetic means for allowing a supply of hydraulic fluid from the lift cylinder to a portion of the second cylinder and discharge of hydraulic fluid from a remaining portion of the second cylinder in response to deenergization of the electromagnetic means, further allowing discharge of hydraulic fluid from the portion of the second cylinder and a supply of hydraulic fluid from the lift cylinder to the remaining portion of the second cylinder in response to energization of the electromagnetic means; and wherein the control circuit comprises a relay including a relay coil, a normally open relay switch connected in series with the relay coil and a normally closed relay switch connected in series with the electromagnetic means, a pressure sensor means including a first switch connected in series with the relay coil for rendering the first switch closed in response to a pressure rise in the lift cylinder, a load carrier height sensor means including a second switch connected in series with the relay coil for rendering the second switch closed when a distance between a lower portion of the load carrier and a surface on which the load carrier is to land becomes shorter than a predetermined value, and a lift control lever position sensor means including a third switch connected in series with the normally open and normally closed relay switches, respectively, rendering the third switch closed when the lift control valve is shifted to the predetermined position.

2. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which is constructed and arranged to cause the electromagnetic means to shift between an energized state thereof and a deenergized state thereof during the downward movement of the load carrier so that during downward movement of the load carrier the degree of flow restriction imparted by the variable flow regulator to hydraulic fluid flow passing through the variable flow regulator in the one direction varies;

wherein the first degree of flow restriction is a maximum degree thereof, and the second degree of flow restriction is a minimum degree thereof; and further including tilt cylinders subjected to the weight of the load carrier and wherein the variable flow regulator comprises a variable flow orifice valve fluidly disposed between the lift cylinder and the lift control valve, a hydraulic actuator including a second cylinder and a piston slidable therein and operatively connected to the variable flow orifice valve to vary an opening area of the variable flow orifice valve in response to slidable movement of the piston in the second cylinder, and a selector valve means operable by the electromagnetic means for allowing a supply of hydraulic fluid from the tilt cylinders to a portion of the second cylinder and discharge of hydraulic fluid from a remaining portion of the second cylinder in response to deenergization of the electromagnetic means, further allowing discharge of hydraulic fluid from the portion of the second cylinder and a supply of hydraulic fluid from the tilt cylinders to the remaining portion of the second cylinders in response to energization of the electromagnetic means;

wherein the control circuit comprises a relay including a relay coil, a normally open relay switch connected in series with the relay coil and a normally closed relay switch connected in series with the electromagnetic means, a pressure sensor means including a first switch connected in series with the relay coil for rendering the first switch closed in response to a pressure rise in the lift cylinder, a load carrier height sensor means including a second switch connected in series with the relay coil for rendering the second switch closed when a distance between a lower portion of the load carrier and a surface on which the load carrier is to land become shorter than a predetermined value, and a lift control lever position sensor means including a third switch connected in series with the normally open and normally closed relay switches, respectively, rendering the third switch closed when the lift control valve is shifted to the predetermined position.

3. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which is constructed and arranged to cause the electromagnetic means to shift between an energized state thereof and a deenergized state thereof during the downward movement of the load carrier so that during downward movement of the load carrier the degree of flow restriction imparted by the variable flow regulator to hydraulic fluid flow passing through the variable flow regulator in the one direction varies;

wherein the first degree of flow restriction is a maximum degree thereof, and the second degree of flow restriction is a minimum degree thereof;

wherein the variable flow regulator comprises a variable flow orifice valve fluidly disposed between the lift cylinder and the lift control valve, a hydraulic actuator including a second cylinder and a piston slidable therein and operatively connected to the variable flow orifice valve to vary an opening area of the variable flow orifice valve in response to slidable movement of the piston in the second cylinder, and a selector valve means operable by the electromagnetic means for allowing a supply of hydraulic fluid from the lift cylinder to a portion of the second cylinder and discharge of hydraulic fluid from a remaining portion of the second cylinder in response to deenergization of the electromagnetic means, further allowing discharge of hydraulic fluid from the portion of the second cylinder and a supply of hydraulic fluid from the lift cylinder to the remaining portion of the second cylinder in response to energization of the electromagnetic means; and wherein the lift control valve has a lift control lever and a rod operatively interconnecting the lift control valve and the lift control lever, and wherein the control circuit comprises a lift control lever positions sensor means including a switch connected in series with the electromagnetic means for rendering the switch closed in response to movement of the rod beyond a predetermined position thereof when the lift control valve has shifted to the predetermined position.

4. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which is constructed and arranged to cause the electromagnetic means to shift between an energized state thereof and a deenergized state thereof during the downward movement of the load carrier so that during downward movement of the load carrier the degree of flow restriction imparted by the variable flow regulator to hydraulic fluid flow passing through the variable flow regulator in the one direction varies;

wherein the first degree of flow restriction is a maximum degree thereof, and the second degree of flow restriction is a minimum degree thereof; and wherein the variable flow regulator comprises a flow restrictor orifice fluidly disposed between the lift cylinder and the lift control valve, a one-way check valve arranged parallel to the flow restrictor orifice, and a selector valve arranged parallel to the flow restrictor orifice, the selector valve having a first position wherein passage of hydraulic fluid flow therethrough is permitted and a second position wherein passage of hydraulic fluid flow therethrough is inhibited.

5. A system as claimed in claim 4, wherein the selector valve remains in the first position in response to deenergization of the electromagnetic means, and shifts to the second position in response to energization of the electromagnetic means.

6. A system as claimed in claim 5, wherein the control circuit comprises a relay including a normally open relay switch connected in series with the electromagnetic means and a relay coil connected in series with the normally open relay switch, a pressure sensor means including a first switch connected in series with the relay coil for rendering the first switch closed in response to a pressure rise in the lift cylinder, and a load carrier height sensor means including a second switch connected in series with the first switch for rendering the second switch closed when a distance between a lower portion of the load carrier and a surface on which the load carrier is to land becomes shorter than a predetermined value wherein the variable flow regulator comprises a flow restrictor orifice fluidly disposed between the lift cylinder and the lift control valve, a one-way check valve arranged parallel to the flow restrictor orifice, and a selector valve arranged parallel to the flow restrictor orifice, the selector valve having a first position wherein passage of hydraulic fluid flow therethrough is permitted and a second position wherein passage of hydraulic fluid flow therethrough is inhibited.

7. A system for controlling a load carrier for an industrial vehicle, the system comprising:

a load carrier;

a lift cylinder subjected to a weight of the load carrier and hydraulically extendable to lift the load carriers;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which is constructed and arranged to cause the electromagnetic means to shift between an energized state thereof and a deenergized state thereof during the downward movement of the load carrier so that during downward movement of the load carrier the degree of flow restriction imparted by the variable flow regulator to hydraulic fluid flow passing through the variable flow regulator in the one direction varies;

wherein the first degree of flow restriction is a maximum degree thereof, and the second degree of flow restriction is a minimum degree thereof; and wherein the variable flow regulator comprises a flow restrictor orifice fluidly disposed between the lift cylinder and the lift control valve, a one-way check valve arranged parallel to the flow restrictor orifice, and a hydraulically operated selector valve arranged parallel to the flow restrictor orifice, the hydraulically operated selector valve having a first position wherein passage of hydraulic fluid flow therethrough is permitted and a second position wherein passage of hydraulic fluid flow therethrough is inhibited, a source of constant hydraulic fluid pressure, an electromagnetically operated selector valve fluidly disposed between the source of constant hydraulic fluid pressure and the hydraulically operated selector valve, and an adjustable flow restrictor orifice fluidly disposed between the electromagnetically operated selector valve and the hydraulically operated selector valve, the electromagnetically operated selector valve having a third position wherein hydraulic fluid is discharged from the hydraulically operated selector valve in response to deenergization of the electromagnetic means and . a fourth position wherein hydraulic fluid from the source of constant hydraulic fluid pressure is supplied to the hydraulically operated selector valve.

8. A system as claimed in claim 7, wherein the control circuit comprises a relay including a normally open relay switch connected in series with the electromagnetic means and a relay coil connected in series with the normally open relay switch, a pressure sensor means including a first switch connected in series with the relay coil for rendering the first switch closed in response to a pressure rise in the lift cylinder, and a load carrier height sensor means including a second switch connected in series with the first switch for rendering said second switch closed when a distance between a lower portion of the load carrier and a surface on which the load carrier is to land becomes shorter than a predetermined value.

9. A system for controlling a load carrier for an industrial vehicle, the system comprising:

a load carrier;

a lift cylinder subjected to a weight of the load carrier and hydraulically extendable to lift the load carriers;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which selectively energizes and deenergizes the electromagnetic means in response to the downward movement of the load carrier, wherein the first degree of flow restriction is a maximum degree thereof, and the second degree of flow restriction is a minimum degree thereof, wherein the variable flow regulator comprises a variable flow orifice valve fluidly disposed between the lift cylinder and the lift control valve, a hydraulic actuator including a second cylinder and a piston slidable therein and operatively connected to the variable flow orifice valve to vary an opening area of the variable flow orifice valve in response to slidable movement of the piston in the second cylinder, and a selector valve means operable by the electromagnetic means for allowing a supply of hydraulic fluid from the lift cylinder to a portion of the second cylinder and discharge of hydraulic fluid from a remaining portion of the second cylinder in response to deenergization of the electromagnetic means, further allowing discharge of hydraulic fluid from the portion of the second cylinder and a supply of hydraulic fluid from the lift cylinder to the remaining portion of the second cylinder in response to energization of the electromagnetic means, wherein the control circuit comprises a relay including a relay coil, a normally open relay switch connected in series with the relay coil and a normally closed relay switch connected in series with the electromagnetic means, a pressure sensor means including a first switch connected in series with the relay coil for rendering the first switch closed in response to a pressure rise in the lift cylinder, a load carrier height sensor means including a second switch connected in series with the relay coil for rendering the second switch closed when a distance between a lower portion of the load carrier and a surface on which the load carrier is to land becomes shorter than a predetermined value, and a lift control lever position sensor means including a third switch connected in series with the normally open and normally closed relay switches, respectively, rendering the third switch closed when the lift control valve is shifted to the predetermined position.

10. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states;

a control circuit which selectively energizes and deenergizes the electromagnetic means in response to the downward movement of the load carrier; and tilt cylinders subjected to the weight of the load carrier, wherein the first degree of flow restriction is a maximum degree thereof, and the second degree of flow restriction is a minimum degree thereof, wherein the variable flow regulator comprises a variable flow orifice valve fluidly disposed between the lift cylinder and the lift control valve, a hydraulic actuator including a second cylinder and a piston slidable therein and operatively connected to the variable flow orifice valve to vary an opening area of the variable flow orifice valve in response to slidable movement of the piston in the second cylinder, and a selector valve means operable by the electromagnetic means for allowing a supply of hydraulic fluid from the lift cylinders to a portion of the second cylinder and discharge of hydraulic fluid from a remaining portion of the second cylinder in response to deenergization of the electromagnetic means, further allowing discharge of hydraulic fluid from the portion of the second cylinder of and a supply of hydraulic fluid from the lift cylinders to the remaining portion of the second cylinder in response to energization of the electromagnetic means, wherein the control circuit comprises a relay including a relay coil, a normally open relay switch connected in series with the relay coil and a normally closed relay switch connected in series with the electromagnetic means, a pressure sensor means including a first switch connected in series with the relay coil for rendering the first switch closed in response to a pressure rise in the lift cylinder, a load carrier height sensor means including a second switch connected in series with the relay coil for rendering the second switch closed when a distance between a lower portion of the load carrier and a surface on which the load carrier is to land becomes shorter than a predetermined value, and a lift control lever position sensor means including a third switch connected in series with the normally open and normally closed relay switches, respectively, rendering the third switch closed when the lift control valve is shifted to the predetermined position.

11. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which selectively energizes and deenergizes the electromagnetic means in response to the downward movement of the load carrier, wherein the first degree of flow restriction is a maximum degree thereof, and the second degree of flow restriction is a minimum degree thereof, wherein the variable flow regulator comprises a variable flow orifice valve fluidly disposed between the lift cylinder and the lift control valve, a hydraulic actuator including a second cylinder and a piston slidable therein and operatively connected to the variable flow orifice valve to vary an opening area of the variable flow orifice valve in response to slidable movement of the piston in the second cylinder, and a selector valve means operable by the electromagnetic means for allowing a supply of hydraulic fluid from the lift cylinder to a portion of the second cylinder and discharge of hydraulic fluid from a remaining portion of the second cylinder in response to deenergization of the electromagnetic means, further allowing discharge of hydraulic fluid from the portion of the second cylinder and a supply of hydraulic fluid from the lift cylinder to the remaining portion of the second cylinder in response to energization of the electromagnetic means, wherein the lift control valve has a lift control lever and a rod operatively interconnecting the lift control valve and the lift control lever, and wherein the control circuit comprises a lift control lever position sensor means including a switch connected in series with the electromagnetic means for rendering the switch closed in response to movement of the rod beyond a predetermined position thereof when the lift control valve has shifted to the predetermined position.

12. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which selectively energizes and deenergizes the electromagnetic means in response to the downward movement of the load carrier, wherein the first degree of flow restriction is a maximum degree thereof, and the second degree of flow restriction is a minimum degree thereof, wherein the variable flow regulator comprises a variable flow orifice valve fluidly disposed between the lift cylinder and the lift control valve, a one-way check valve arranged parallel to the flow restrictor orifice, and a selector valve arranged parallel to the flow restrictor orifice, the selector valve having a first position wherein passage of hydraulic fluid flow therethrough is permitted and a second position wherein passage of hydraulic fluid flow therethrough is inhibited.

13. A system as claimed in claim 12, wherein the selector valve means in the first position in response to deenergization of the electromagnetic means, and shifts to the second position in response to energization of the electromagnetic means.

14. A system as claimed in claim 13, wherein the control circuit comprises a relay including a normally open relay switch connected in series with the electromagnetic means and a relay coil connected in series with the normally open relay switch, a pressure sensor means including a first switch connected in series with the relay coil for rendering the first switch closed in response to a pressure rise in the lift cylinder, and a load carrier height sensor means including a second switch connected in series with the first switch for rendering the second switch closed when a distance between a lower portion of the load carrier and a surface on which the load carrier is to land becomes shorter than a predetermined value.

15. A system for controlling a load carrier for an industrial vehicle, the system comprising:

a load carrier;

a lift cylinder subjected to a weight of the load carrier and hydraulically extendable to lift the load carrier;

a lift control valve which is shiftable between a neutral position and a predetermined position so that discharge of hydraulic fluid from the lift cylinder is allowed to permit a downward movement of the load carrier;

a variable flow regulator fluidly disposed between the lift cylinder and the lift control valve, the variable flow regulator having a first state which imparts a first degree of flow restriction to a hydraulic fluid flow passing therethrough in one direction from the lift cylinder to the lift control valve, and a second state which imparts a second degree of flow restriction to the hydraulic fluid flow passing therethrough in the one direction;

electromagnetic means for shifting the variable flow regulator between the first and second states; and a control circuit which selectively energizes and de-energizes the electromagnetic means in response to the downward movement of the load carrier, wherein the first degree of flow restriction is a maximum degree thereof, and the second degree of flow restriction is a minimum degree thereof, wherein the variable flow regulator comprises a variable flow orifice valve fluidly disposed between the lift cylinder and the lift control valve, a one-way check valve arranged parallel to the flow restrictor orifice, and a hydraulically operated selector valve arranged parallel to the flow restrictor orifice, the hydraulically operated selector valve having a first position wherein passage of hydraulic fluid flow therethrough is permitted and a second position wherein passage of hydraulic fluid flow therethrough is inhibited, a source of constant hydraulic fluid pressure, an electromagnetically operated selector valve fluidly disposed between the source of constant hydraulic fluid pressure and the hydraulically operated selector valve, and an adjustable flow restrictor orifice fluidly disposed between the electromagnetically operated selector valve and the hydraulically operated selector valve, the electromagnetically operated selector valve having a third position wherein hydraulic fluid is discharged from the hydraulically operated selector valve in response to deenergization of the electromagnetic means and a fourth position wherein hydraulic fluid from the source of constant hydraulic fluid pressure is supplied to the hydraulically operated selector valve.

16. A system as claimed in claim 15, wherein the control circuit comprises a relay including a normally open relay switch connected in series with the electromagnetic means and a relay coil connected in series with the normally open relay switch, a pressure sensor means including a first switch connected in series with the relay coil for rendering the first switch closed in response to a pressure rise in the lift cylinder, and a load carrier height sensor means including a second switch connected in series with the first switch for rendering the second switch closed when a distance between a lower portion of the load carrier and a surface on which the load carrier is to land becomes shorter than a predetermined value.

* * * * *